United States Patent [19]

Sekiguchi

[11] Patent Number: 4,815,880

[45] Date of Patent: Mar. 28, 1989

[54] CARD TYPE WRITING INSTRUMENT

[75] Inventor: Kazuhiko Sekiguchi, Tokyo, Japan

[73] Assignee: Zebra Co., Ltd., Tokyo, Japan

[21] Appl. No.: 111,512

[22] Filed: Oct. 21, 1987

[30] Foreign Application Priority Data

Oct. 25, 1986 [JP] Japan ..... 61-162905
Nov. 12, 1986 [JP] Japan ..... 61-267487

[51] Int. Cl.[4] ..... B43K 31/00; B43K 29/00; B43K 27/00; B43K 9/00

[52] U.S. Cl. ..... 401/6; 401/18; 401/20; 401/29; 401/35; 401/131; 401/213; 401/243; 211/69.9

[58] Field of Search ..... 211/69.1, 69.2, 69.3, 211/69.9; 401/6, 34, 35, 29, 18, 20, 131, 213, 243

[56] References Cited

U.S. PATENT DOCUMENTS

| | | | |
|---|---|---|---|
| 710,293 | 9/1902 | McClung | 211/69.9 |
| 825,985 | 7/1906 | DeSchwertenberg | 401/6 |
| 1,573,699 | 2/1926 | Giovannetti | 401/35 |
| 1,687,136 | 10/1928 | Myers | 211/69.9 |
| 2,412,938 | 12/1946 | Amoth | 211/69.9 X |
| 4,243,338 | 1/1981 | Williams | 401/6 X |

FOREIGN PATENT DOCUMENTS

| | | | |
|---|---|---|---|
| 971843 | 1/1951 | France | 401/35 |
| 1226237 | 7/1960 | France | 401/35 |
| 2431377 | 3/1980 | France | 401/6 |
| 341404 | 11/1959 | Switzerland | 211/69 |

*Primary Examiner*—Steven A. Bratlie
*Attorney, Agent, or Firm*—Wenderoth, Lind & Ponack

[57] ABSTRACT

A card type writing instrument has a casing made of plastics and at least one recess formed therein. Also, at least one flat writing element capable of being removably fitted into the recess in the casing is provided. When the writing element is held in the recess it is essentially integral with the casing and defines the shape of a card. The writing instrument may include a variety of writing elements such as a mechanical pencil unit and ball-point pen unit by providing a plurality of recesses in the casing for receiving the writing elements.

5 Claims, 9 Drawing Sheets

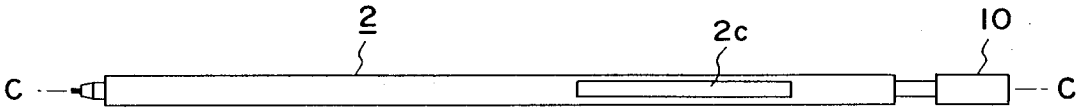
Fig. 8
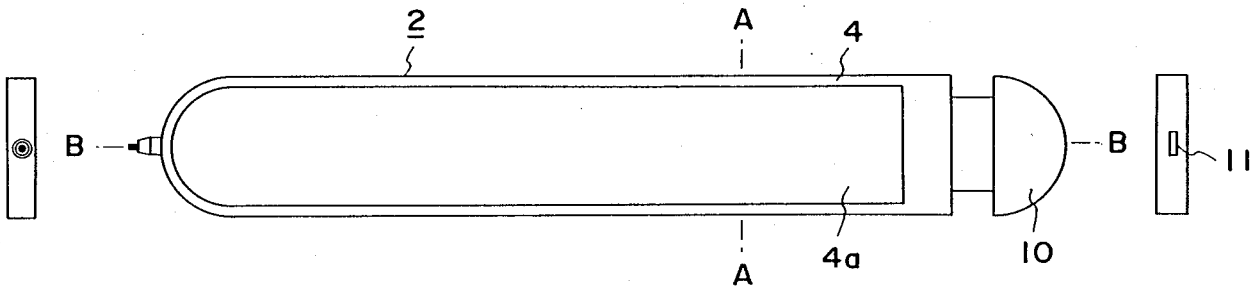
Fig. 9c
Fig. 9
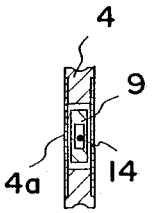
Fig. 9b Fig. 9a

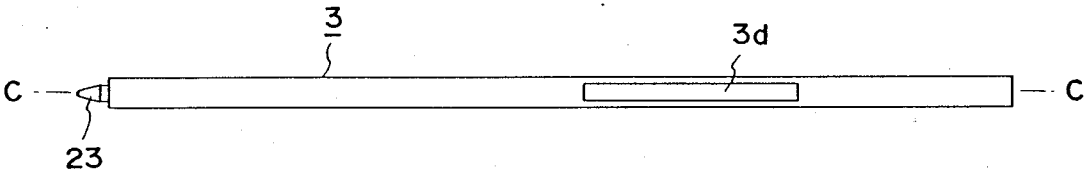
Fig. 13
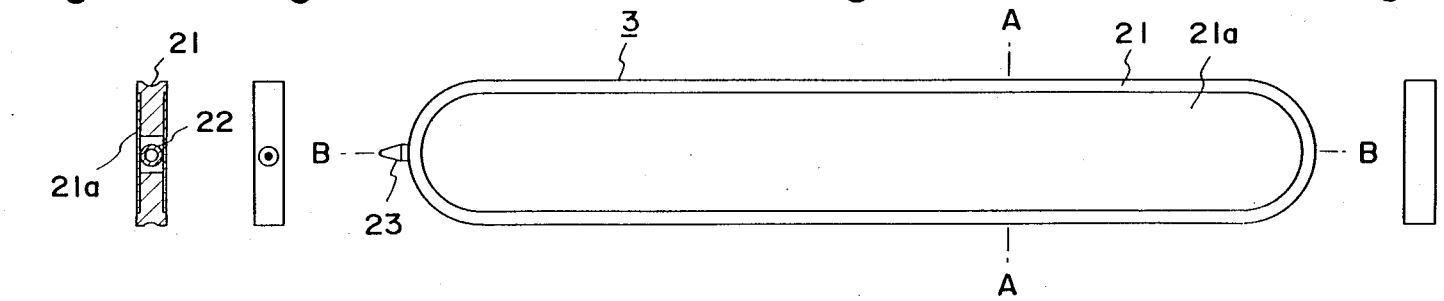
Fig. 14c
Fig. 14
Fig. 14b Fig. 14a

CARD TYPE WRITING INSTRUMENT

BACKGROUND OF THE INVENTION

The present invention relates to a card type writing instrument which is compact and quite handy to carry. The instrument may include a plurality of writing elements such as a mechanical pencil unit and ball-point pen unit.

SUMMARY OF THE INVENTION

Various kinds of writing instruments which are handy to carry have so far been developed but their modes of use have remained unchanged and at present, the appearance of a writing instrument which has an avant-garde construction compact enough for one to carry it in one's pocket and the like is being demanded.

The present invention has been made to meet the above-mentioned demand and an object of the invention is to provide a writing instrument having an up-to-date design in a compact form and quite handy to carry.

The gist of the present invention resides with a card type writing instrument which features that one or a plurality of writing elements is or are removably fitted into recess or recesses formed in a cardlike casing.

BRIEF DESCRIPTION OF THE DRAWINGS

FIGS. 8 through 12 are illustrative views of a retractable type mechanical pencil unit 2;

FIG. 8 is a plane view of the same;

FIG. 9 is front view of the same;

FIG. 9*a* is a leftside view of the same;

FIG. 9*b* is a sectional view taken along the A—A line of FIG. 9;

FIG. 9*c* is a rightside view of the same;

FIG. 10 is a sectional view taken along the B—B line of FIG. 9;

FIG. 11 is a sectional view taken along the C—C line of FIG. 8;

FIG. 12 is an illustrative view showing a state in which a press head 10 of the mechanical pencil unit 2 is pressed down;

FIGS. 13 through 16 are views illustrating a ball-point pen unit 3 of which FIG. 13 is a plane view of the unit 3;

FIG. 14 is a front view of the same;

FIG. 14*a* is a rightside view of the same;

FIG. 14*b* is a sectional view taken along the A—A line of FIG. 14;

FIG. 14*c* is a rightside view of the same;

FIG. 15 is a sectional view taken along the B—B line of FIG. 14; and

FIG. 16 is a sectional view taken along the C—C line of FIG. 13.

DETAILED DESCRIPTION OF THE INVENTION

Figure 1:
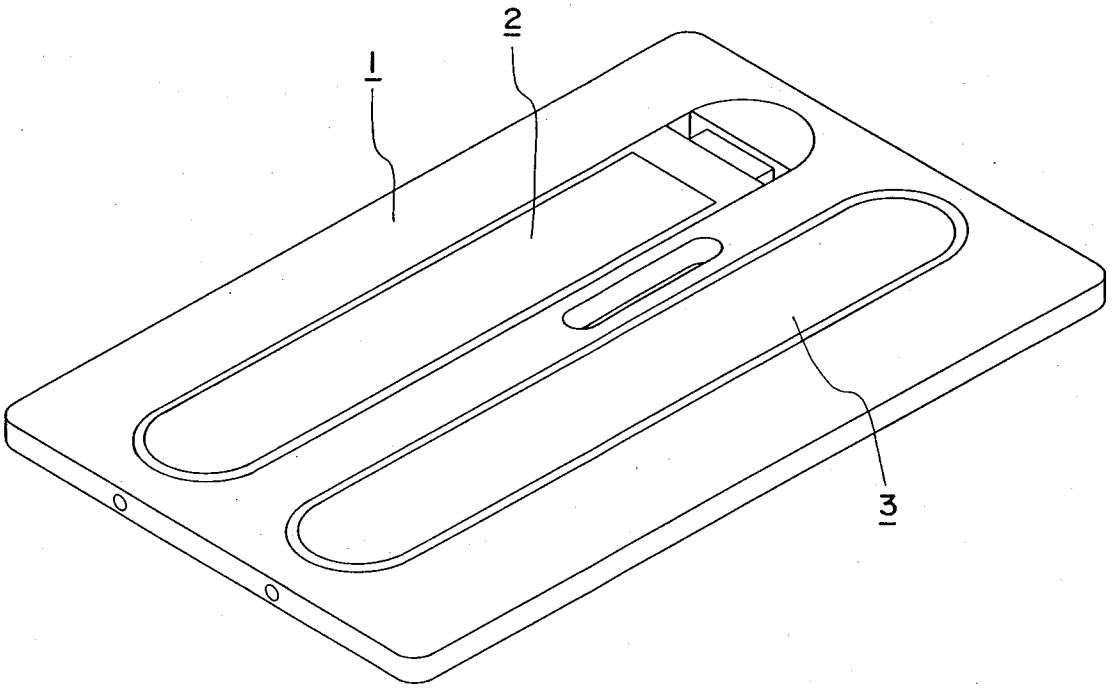
FIGS. 1 through 3 are perspective views of a composite writing instrument as one embodiment of the present invention particularly given for the purpose of illustrating how writing units of the instrument are received in a casing.
Figure 2:
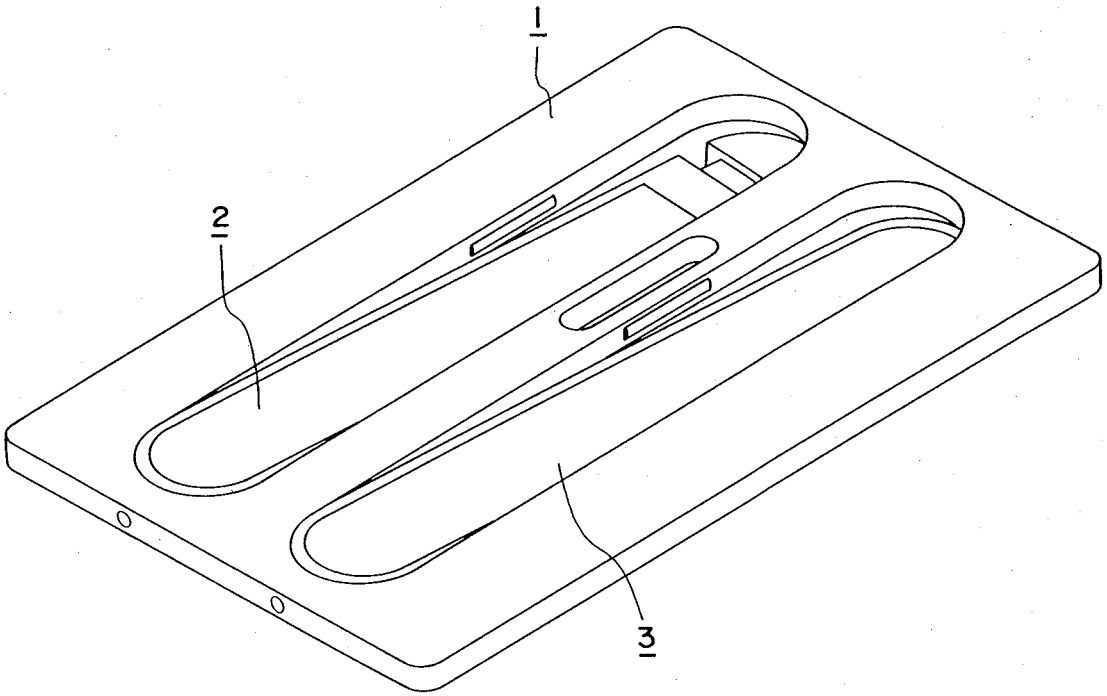
Figure 3:
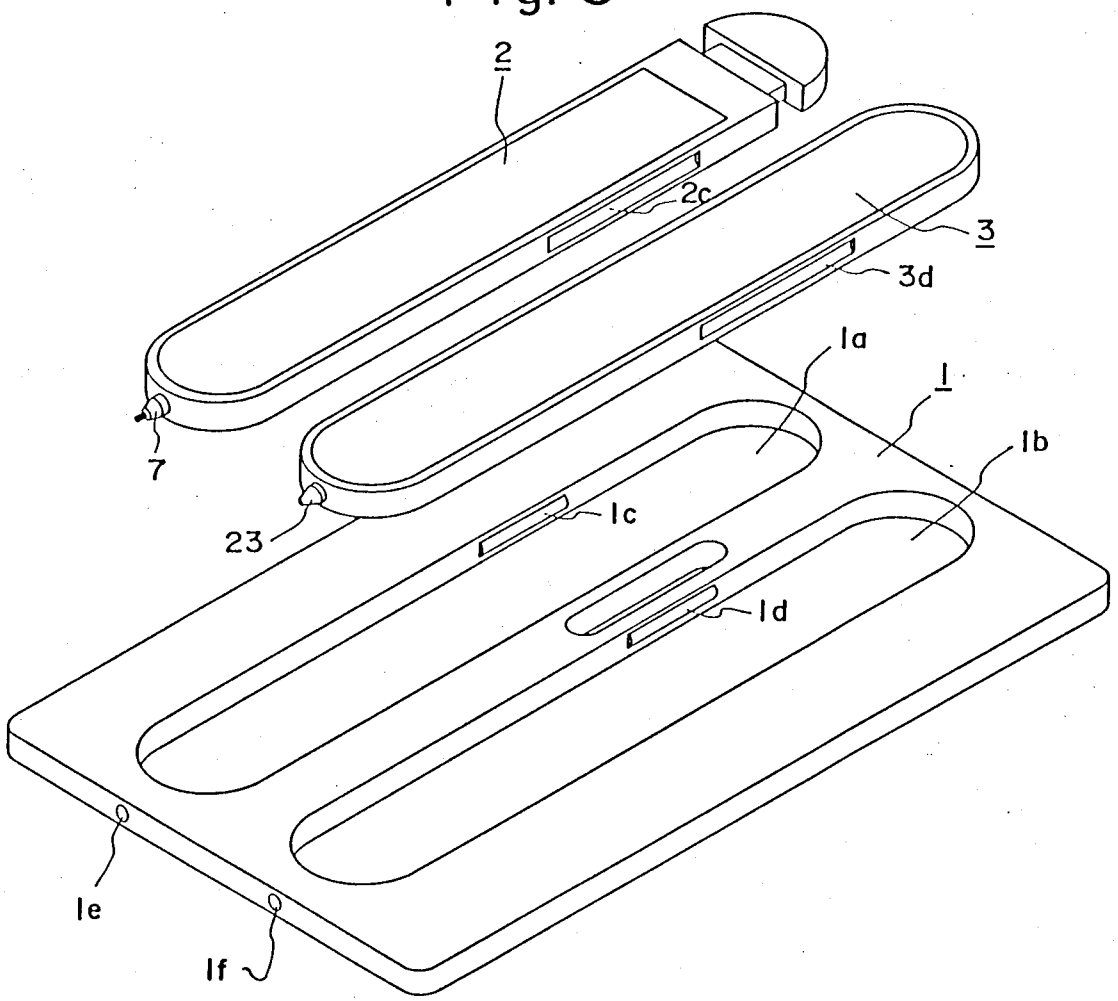
Figure 4:
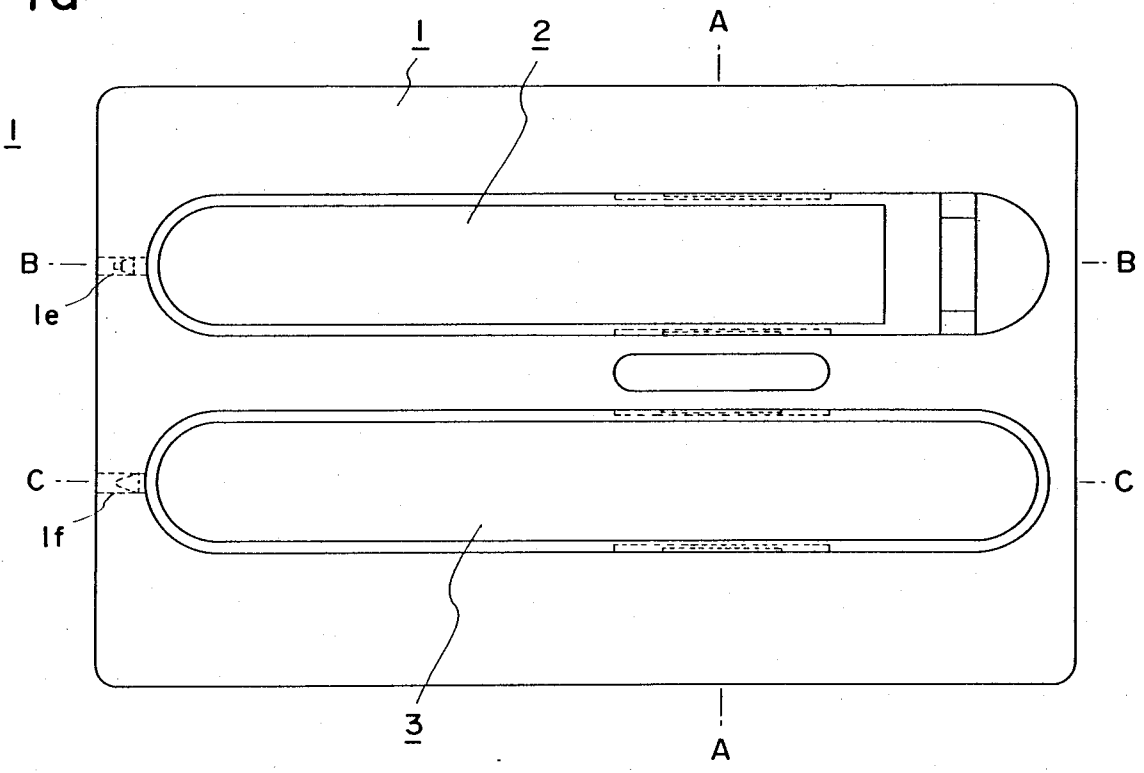
FIG. 4 is a front view of the writing instrument shown in FIG. 1.

One embodiment of the present invention will now be described with reference to the accompanying drawings wherein:

FIGS. 1 through 3 are perspective views, respectively, of a writing instrument as one embodiment of the present invention, especially in a state in which a plurality of writing elements are received within a casing and FIG. 4 is a front view of the same.

In the drawings, reference numeral 1 designates a cardlike casing. Although there is not so strict a size-limitation, the casing 1 is generally about 5 cm long, 8 cm wide and 2 to 3 mm thick and made of plastics, for example, so that it may be conveniently put into a pocket book such as a commutation ticket case or a visiting card case for receiving a telephone card, credit card and the like.

Figure 4A:
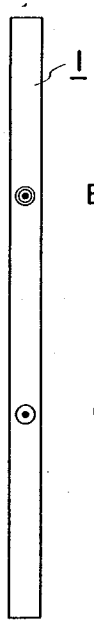
FIG. 4*a* is a leftside view of the same.

The casing 1 is provided with recesses 1*a* and 1*b* having shapes suitable for receiving a flat mechanical pencil unit 2 and a flat ball-point pen unit 3, respectively, in the forms shown in FIG. 3. On the longitudinal peripheral surface of the recesses 1*a* and 1*b*, there are formed two opposing pairs of projections 1*c*, 1*c* and 1*d*, 1*d* which come into engagement with a pair of grooves 2*c*, 2*c* formed in both sides of the mechanical pencil unit 2 and a pair of grooves 3*d*, 3*d* formed in both sides of the ball-point pen unit 3, respectively, when the units 2 and 3 are fitted into the casing 1. Further, the top ends of the recesses 1*a* and 1*b* are provided with holes 1*e* and 1*f*, respectively, so that when the units 2 and 3 are fitted into the casing 1, a tip 7 of the unit 2 and a tip 23 of the unit 3 are received into the holes, respectively. (See FIGS. 4 and 4*a*).

Figure 5:
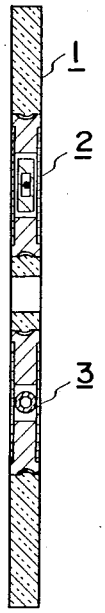
FIG. 5 is a sectional view taken along the A—A line of FIG. 4.
Figure 6:
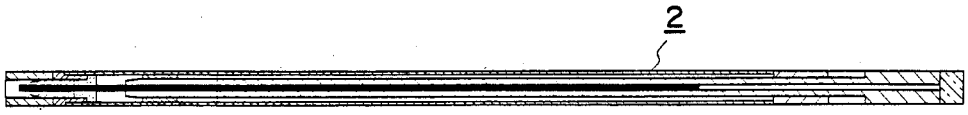
FIG. 6 is a sectional view taken along the B—B line of FIG. 4.
Figure 7:
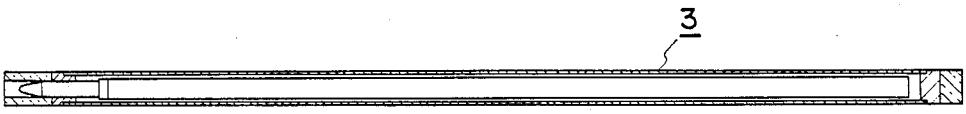
FIG. 7 is a sectional view taken along the C—C line of FIG. 4.
Figure 10:
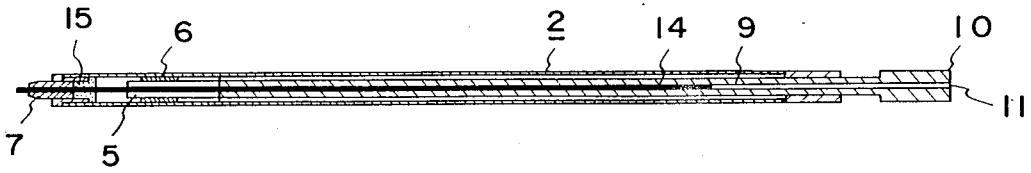
Figure 11:
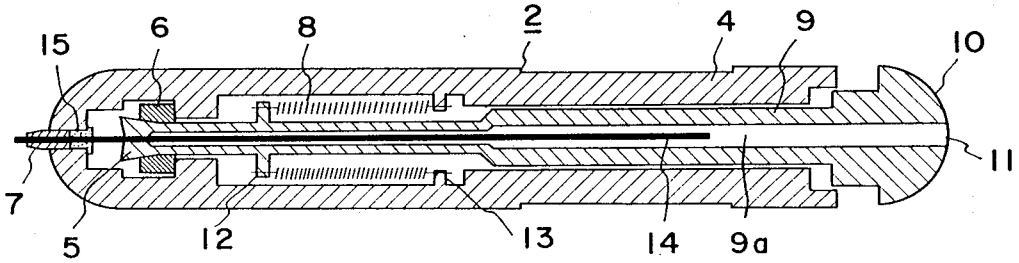
Figure 12:
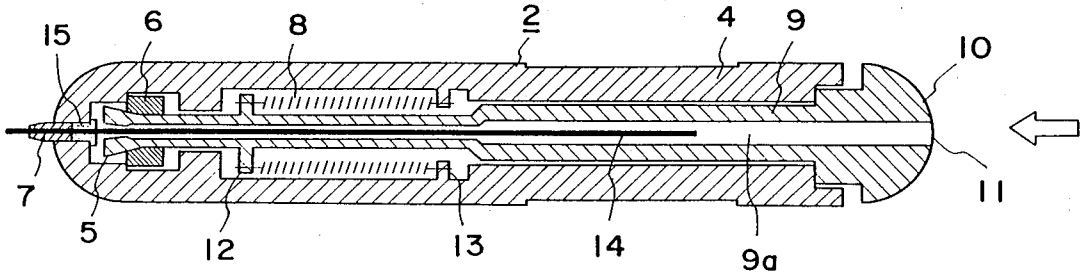
Figure 15:
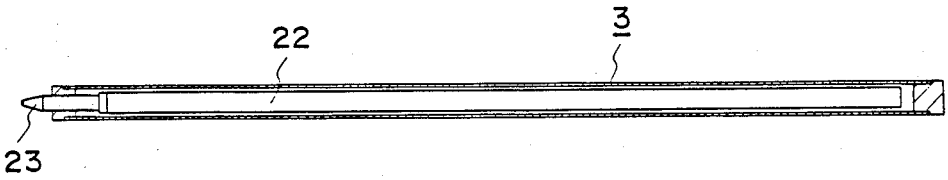
Figure 16:
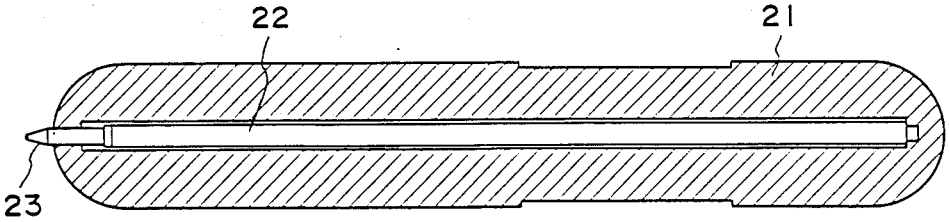

FIG. 5 is a sectional view taken along the A—A line of FIG. 4, FIG. 6 is a sectional view of the B—B line of FIG. 4 and FIG. 7 is a sectional view taken along the C—C line of FIG. 4.

Next, the structure of the mechanical pencil unit 2 and that of the ball-point pen unit 3 will be described with reference to FIGS. 8 through 12.

In the drawings, reference numeral 4 designates a mechanical pencil unit body and reference numeral 4*a* designates a cover plate to cover the upper and lower side surfaces of the body 4. As will be clear from the drawings, the mechanical pencil unit body 4 is flat and has a thickness substantially the same as that of the casing 1. Within the body 4, there is stored a chuck mechanism comprising a split pawl chuck 5 and a clamping ring 6 with the rear end of the chuck 5 extending to become integral with a lead guide section 9. Reference numeral 10 designates the press head extending to the section 9. At the top of the press head 10 there is provided an opening 11 for feeding a lead 14 which opening is in communication with a guide cavity 9*a* of the lead guide 9.

The split pawl chuck 5 is provided with an engaging section 12 to engage one end of a spring 8 and within the mechanical pencil unit body 4 there is provided an engaging section 13 to engage the other end of the spring 8. Due to the provision of the spring 8, the split pawl chuck 5 is urged in the rearward direction to a position at which it usually is in the state shown in FIG. 11 and the lead 14 is held clamped by the chuck mechanism. The chuck mechanism is shifted reciprocally in the axial direction of the mechanical pencil unit 2 through the operation of the press head 10 in the usual manner thereby feeding out the lead 14 to a writing position. (See FIG. 12). Reference numeral 15 designates a lead holder.

Next, the structure of the flat ball-point pen unit 3 will be described with reference to FIGS. 13 through 16.

In the drawings, reference numeral 21 designates a ball-point pen body, reference numeral 22 designates an ink storage tube incorporated into the inner cavity of the body 21, reference numeral 23 designates the ball-point pen tip and reference numeral 21a designates a cover plate to cover the upper and lower sides of the body 21. As will be clear from the above drawings, the ball-point pen unit 3 is flat and the thickness thereof is substantially equal to that of the casing 1 so that when the unit 3 is fitted into the casing 1 as in the case of the mechanical pencil unit 2, it becomes integral with the casing 1 representing a cardlike shape.

It should be noted that although the present invention has been described in the foregoing in relation to a composite writing instrument comprising a mechanical pencil unit and a ball-point pen unit, the invention is not always limited thereto and it is of course possible with the invention to construct a composite writing instrument by combining one or a plurality of writing elements.

The writing instrument according to the present invention is so constructed that one or a plurality of flat writing units is or are removably received within the corresponding recess or recesses of a cardlike casing in an integrated card form and therefore, it produces a practical effect of being extremely handy to carry.

What is claimed is:

1. A writing instrument comprising, in combination, a substantially rectangular and flat cardlike casing, and at least one writing device:

said substantially rectangular cardlike casing having two pairs of spaced opposed sides and a substantially flat top and bottom, at least one through hole in said top and bottom for receiving said at least one writing device therein, engagement means in said through hole for detachably engaging said at least one writing device when said at least one writing device is received in said through hole, at least one tip-receiving hole in a side of said through hole for receiving a writing tip of said at least one writing device when said at least one writing device is detachably engaged in said at least one through hole; and at least one writing device receivable in said at least one through hole of said cardlike casing, said at least one writing device having a writing tip receivable in said tip-receiving hole of said at least one through hole, said at least one writing device being substantially flat and having substantially the same thickness as said flat cardlike casing, and when said at least one writing instrument is detachably received in said through hole said writing instrument is substantially flat.

2. A device as in claim 1, wherein said at least one writing device has substantially the same size and volume as said at least one through hole.

3. A device as in claim 1, wherein said at least one writing device includes a mechanical pencil and a pen.

4. A writing instrument comprising, in combination, a rectangular and flat cardlike casing, a retractable mechanical pencil, and a ball-point pen:

said rectangular cardlike casing having a top and bottom, a pair of longer sides, a pair of shorter sides, two substantially elliptical through holes in said top and bottom for receiving either one of said pencil and pen therein, respectively, each said two substantially elliptical through holes having a pair of spaced opposed sides, a spaced opposed projection being on each one of said pairs of spaced opposed sides for detachably engaging each one of said pen and pencil when one of said pen and pencil is received in one of said two through holes, and two tip-receiving holes in at least one of said sides of said cardlike casing, each said tip-receiving hole being a through hole extending from the said at least one side to one of said two substantially elliptical through holes for receiving a writing tip of either one of said pen and pencil therein, and each said tip-receiving hole receiving a writing tip of either one of said pen and pencil therein when either one of said pen and pencil is received in one of said two substantially elliptical through holes;

said mechanical pencil having a writing tip and two spaced opposed side surfaces, and a spaced opposed groove in each one of said side surfaces for receiving one of said spaced opposed projections of one of said substantially elliptical through holes when said mechanical pencil is received therein; and said pen having a pen writing tip and two spaced opposed side surfaces, and a spaced opposed groove in each one of said side surfaces for receiving one of said spaced opposed projections of one of said substantially elliptical through holes when said pen is received therein.

5. A writing instrument comprising, in combination, a rectangular and flat plastic cardlike casing, a retractable mechanical pencil, and a ball-point pen:

said rectangular cardlike casing having a top and bottom, a pair of longer sides of about 8 cm in length, a pair of shorter sides of about 5 cm in length, and a thickness of about 3 mm, two substantially elliptical through holes in said top and bottom for receiving either one of said pencil and pen therein, respectively, and the longitudinal axis of each one of said two substantially elliptical through holes being substantially parallel to the longitudinal axis of said card, each said two substantially elliptical through holes having a pair of spaced opposed sides, a spaced opposed projection being on each one of said pairs of spaced opposed sides for detachably engaging each one of said pen and pencil when one of said pen and pencil is received in one of said two through holes, and two tip-receiving holes in at least one of said shorter sides of said cardlike casing, each said tip-receiving hole being a through hole extending from said at least one shorter side to one of said two substantially elliptical through holes for receiving a writing tip of either one of said pen and pencil therein, and each said tip-receiving hole receiving a writing tip of either one of said pen and pencil therein when either one of said pen and pencil is received in one of said two substantially elliptical through holes;

said mechanical pencil having a writing tip and two spaced opposed side surfaces, and a spaced opposed groove in each one of said side surfaces for receiving one of said spaced opposed projections of one of said substantially elliptical through holes when said mechanical pencil is received therein; and said pen having a pen writing tip and two spaced opposed side surfaces, and a spaced opposed groove in each one of said side surfaces for receiving one of said spaced opposed projections of one of said substantially elliptical through holes when said pen is received therein.

* * * * *